US006685749B1

(12) United States Patent
Rock et al.

(10) Patent No.: US 6,685,749 B1
(45) Date of Patent: Feb. 3, 2004

(54) FABRICS WITH SURFACES OF CONTRASTING COLORS AND/OR DIFFERENT CONTOUR

(75) Inventors: Moshe Rock, Andover, MA (US); Amnon Gabay, Newtonville, MA (US); Charles Haryslak, Haverhill, MA (US); William K. Lie, Methuen, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 152 days.

(21) Appl. No.: 09/619,937

(22) Filed: Jul. 20, 2000

(51) Int. Cl.[7] ..... D06M 15/00; D06P 5/00; D06P 5/12

(52) U.S. Cl. ..... 8/115.51; 8/115.7; 8/445; 8/446; 8/916; 8/920

(58) Field of Search ..... 8/115.7, 445, 446, 8/916, 920

(56) References Cited

U.S. PATENT DOCUMENTS

| | | | | |
|---|---|---|---|---|
| 670,396 A | | 3/1901 | Collin | |
| 2,093,651 A | | 9/1937 | Widmer et al. | 8/5 |
| 2,189,017 A | | 2/1940 | Rivat | 8/64 |
| 2,969,271 A | | 1/1961 | Markgraf et al. | 8/10 |
| 3,849,158 A | | 11/1974 | Palmer et al. | |
| 3,954,074 A | * | 5/1976 | Wildeman | 112/402 |
| 4,000,342 A | | 12/1976 | Rochelle et al. | |
| 4,345,907 A | * | 8/1982 | Wegele et al. | 8/444 |
| 4,351,638 A | * | 9/1982 | Finlayson, III et al. | 8/463 |
| 4,443,505 A | | 4/1984 | Ehrenfeld, Jr. | 428/89 |
| 4,680,033 A | | 7/1987 | Diirl et al. | 8/449 |
| 5,066,535 A | | 11/1991 | Christie | 8/446 |

FOREIGN PATENT DOCUMENTS

| | | |
|---|---|---|
| EP | 0 120 709 | 10/1984 |
| GB | 2 023 192 | 12/1979 |
| WO | WO 96/09429 | 3/1996 |

OTHER PUBLICATIONS

European Search Report; EP 01 30 5948; Apr. 5, 2002; P. Van Gelder.

Patent Abstracts of Japan; vol. 017, No. 364 (C–1081): Jul. 9, 1993 & JP 05 051877 A; Mar. 2, 1993 Abstract.

* cited by examiner

*Primary Examiner*—Yogendra N. Gupta
*Assistant Examiner*—Preeti Kumar
(74) *Attorney, Agent, or Firm*—Fish & Richardson P.C.

(57) ABSTRACT

Fabrics, formed, for example, by joining stitch and loop yarns to form a fabric prebody, with the loop yarn forming in loops that overlay the stitch yarn at the technical face and back of the fabric prebody, and thereafter finishing the fabric prebody to form raised fleece at both surfaces, have a first surface and an opposite, second surface of contrasting, i.e., different, colors. Regions of one or both surfaces may be treated to resist raising so that design elements of the raised or fleece regions stand out in relief, forming surface(s) with contour. Methods of forming the fabrics are also described.

24 Claims, 7 Drawing Sheets

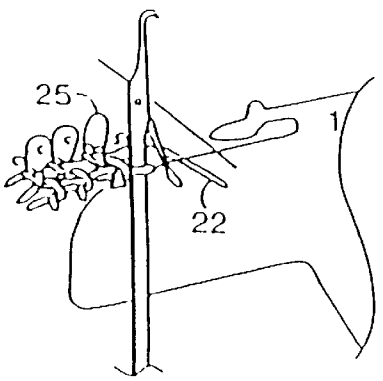
FIG. 5
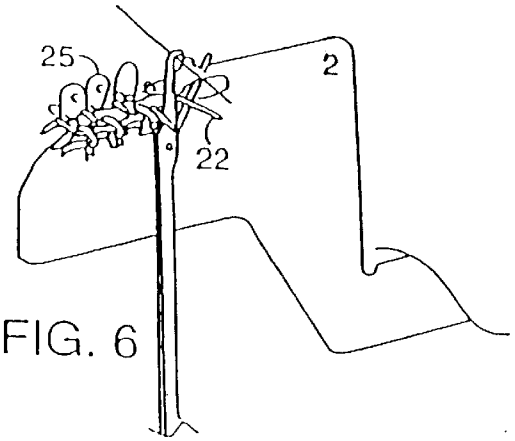
FIG. 6
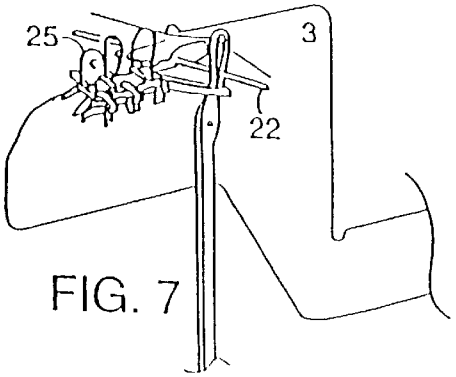
FIG. 7
FIG. 8
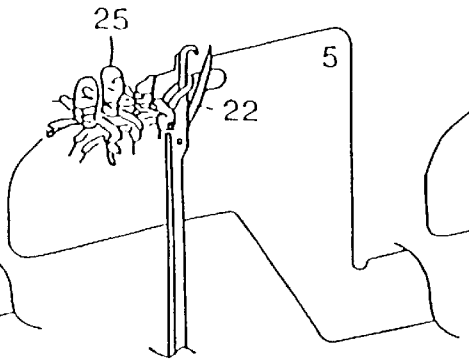
FIG. 9
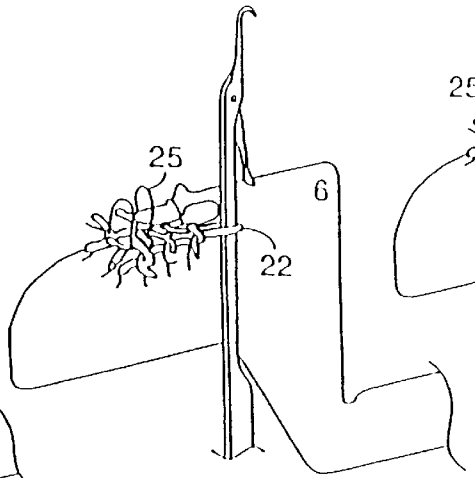
FIG. 10
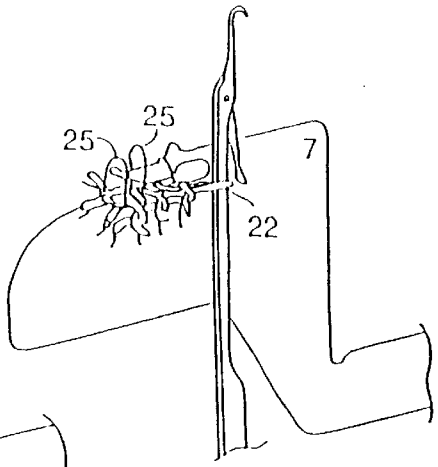
FIG. 11

FABRICS WITH SURFACES OF CONTRASTING COLORS AND/OR DIFFERENT CONTOUR

TECHNICAL FIELD

This invention relates to fabrics, and also to methods of forming fabrics, with opposite surfaces having contrasting, i.e., different, colors and/or raised or fleece surface regions (s) of different contour.

BACKGROUND

It is known to provide a composite fabric article having opposite surfaces of contrasting colors by joining together, in face-to-face arrangement, e.g., by laminating or stitching, two separately formed fabrics of different colors.

SUMMARY

According to one aspect of the invention, a method of forming a fabric body having a first surface and an opposite, second surface, one surface being of a color A and the other surface being of a color B contrasting to color A, comprises the steps of: forming a fabric prebody having first surface and an opposite, second surface; dyeing the fabric prebody color A; transforming the fabric prebody into a fabric body by finishing at least one of the first and the opposite, second surface to form a raised or fleece surface region; removing dye of color A from the raised or fleece surface region of one surface; and re-dyeing the raised or fleece surface region of one surface color B.

According to another aspect of the invention, a method of forming a fabric body having a first surface and an opposite, second surface, one surface being of a color A and the other surface being of a color B contrasting to color A, comprises the steps of: forming a fabric prebody having first surface and an opposite, second surface; dyeing the fabric prebody color A; transforming the fabric prebody into a fabric body by finishing at least one of the first surface and the opposite, second surface to form a raised or fleece surface region; and over-dyeing the raised or fleece surface region of one surface color B.

According to still another aspect of the invention, a fabric has a body with a first surface and an opposite, second surface, at least one of the first surface and the second surface having a raised or fleece region, and one surface being of a color A and the other surface being of a color B contrasting to color A.

According to one embodiment of another aspect of the invention, a method of forming a fabric having at least one raised or fleece surface region on at least one surface bordered by a surface region not raised or fleece comprises the steps of: on a standard terry, reverse circular knit fabric prebody having a technical face and a technical back, raising or fleecing the technical face; printing at least one selected region of the technical back with a resist material; after aging and washing, raising or fleecing, and then shearing, the technical back of the fabric prebody to form a fabric body, with fibers in the selected region(s) printed with resist material matted or held against the technical back of the fabric body by the resist material, thus limiting raising or fleecing; and tumbling the fabric body to gather or clump the raised or fleece fibers away from the selected region(s) printed with the resist material.

According to another embodiment of this aspect of the invention, a method of forming a fabric having at least one raised or fleece region on one or both surfaces, bordered by a surface region not raised or fleece, comprises the steps of: on a standard terry, reverse circular knit fabric prebody having a technical face and a technical back, printing at least one selected region of the technical face and/or the technical back with a resist material; after aging and washing, raising or fleecing, and then shearing, the technical face and the technical back of the fabric prebody to form a fabric body, with fibers in the selected region(s) printed with resist material matted or held against the technical face and/or the technical back of the fabric body by the resist material, thus limiting raising or fleecing; and tumbling the fabric body to gather or clump raised or fleece fibers away from the selected region(s) printed with resist material.

In preferred embodiments of this aspect of the invention, the method comprises the further step of printing at least one of the technical face and the technical back of the fabric prebody, and preferably printing both the technical face and the technical back, with one or more additional colors using subsequent print screens in series.

According to still another aspect of the invention, a fabric has at least one raised or fleece region bordered by a resist region not raised or fleece, to the effect that the design elements of the bordered raised or fleece region stands out in relief.

According to another aspect of the invention, a method of forming a fabric body having a technical face with a raised or fleece surface region, and a technical back with at least one raised or fleece surface region bordered by a surface region not raised or fleece, one of the technical face and the technical back being of a color A and the other of the technical face and the technical back being of a color B contrasting to color A, comprises the steps of: on a standard terry, reverse circular knit fabric prebody having a technical face and a technical back, dyeing the fabric prebody color A; transforming the fabric prebody into a fabric body by finishing the technical face to form a raised or fleece surface region; removing dye of color A from the raised or fleece surface region of the technical face; printing at least one selected region of the technical back with a resist material; after aging and washing, raising or fleecing, and then shearing, the technical back of the fabric body, with fibers in the selected region(s) printed with resist material matted or held against the technical back of the fabric body by resist material, thus limiting raising or fleecing; tumbling the fabric body to gather or clump raised or fleece fibers away from the selected region(s) of the technical back printed with resist material; and over-dyeing the raised or fleece surface region of the technical face color B.

According to yet another aspect of the invention, a method of forming a fabric body having a technical face with a raised or fleece surface region, and a technical back with at least one raised or fleece surface region bordered by a surface region not raised or fleece, one of the technical face and the technical back being of a color A and the other of the technical face and the technical back being of a color B contrasting to color A, comprises the steps of: on a standard terry, reverse circular knit fabric prebody having a technical face and a technical back, dyeing the fabric prebody color A; transforming the fabric prebody into a fabric body by finishing the technical face to form a raised or fleece surface region; printing at least one selected region of the technical back with a resist material; after aging and washing, raising or fleecing, and then shearing, the technical back of the fabric body, with fibers in the selected region(s) printed with resist material matted or held against the technical back of the fabric body by resist material, thus limiting raising or fleecing; tumbling the fabric body to gather or clump raised or fleece fibers away from the selected region(s) of the technical back printed with resist material; and over-dyeing the raised or fleece surface region of the technical face color B.

According to another aspect of the invention, a method of forming a fabric body having a technical face with a raised or fleece surface region, and a technical back with at least one raised or fleece surface region bordered by a surface region not raised or fleece, one of the technical face and the technical back being of a color A and the other of the technical face and the technical back being of a color B contrasting to color A, comprises the steps of: on a standard terry, reverse circular knit fabric prebody having a technical face and a technical back, dyeing a fabric prebody color A; printing at least one selected region of the technical back with a resist material; after aging and washing, raising or fleecing, and then shearing, the technical face and the technical back of the fabric prebody to form a fabric body, with fibers in the selected region(s) of the technical back printed with resist material matted or held against the technical back of the fabric body by resist material, thus limiting raising or fleecing; tumbling the fabric body to gather or clump raised or fleece fibers away from the selected region(s) of the technical back printed with resist material; and over-dyeing at least one raised or fleece surface region of the technical face and the technical back color B.

Preferred embodiments of this aspect of the invention may include one or more of the following additional features. The step of over-dyeing comprises over-dyeing the raised or fleece surface region of the technical face color B, or the step of over-dyeing comprises over-dyeing at least one raised or fleece surface region of the technical back, or the step of over-dyeing comprises over-dyeing at least one raised or fleece surface region of the technical face and over-dyeing at least one raised or fleece surface region of the technical back.

According to yet another aspect of the invention, a method of forming a fabric body having a technical face with a raised or fleece surface region, and a technical back with at least one raised or fleece surface region bordered by a surface region not raised or fleece, one of the technical face and the technical back being of a color A and the other of the technical face and the technical back being of a color B contrasting to color A, comprises the steps of: on a standard terry, reverse circular knit fabric prebody having a technical face and a technical back, dyeing the fabric prebody color A; transforming the fabric prebody into a fabric body by finishing the technical face to form a raised or fleece surface region; printing at least one selected region of the technical back with a resist material; after aging and washing, raising or fleecing, and then shearing, the technical back of the fabric body, with fibers in the selected region(s) printed with resist material matted or held against the technical back of the fabric body by resist material, thus limiting raising or fleecing; tumbling the fabric body to gather or clump raised or fleece fibers away from the selected region(s) of the technical back printed with resist material; and over-dyeing at least one region raised or fleece surface region of the technical back color B.

In a preferred embodiment of this aspect of the invention, the step of over-dyeing comprises applying a pattern of regions of color B to the technical back contrasting to regions of color A on the technical back.

According to still another aspect of the invention, a method of forming a fabric body having a technical face with a raised or fleece surface region, and a technical back with at least one raised or fleece surface region bordered by a surface region not raised or fleece, one of the technical face and the technical back being of a color A and the other of the technical face and the technical back being of a color B contrasting to color A, comprises the steps of: on a standard terry, reverse circular knit fabric prebody having a technical face and a technical back, dyeing the fabric prebody color A; transforming the fabric prebody into a fabric body by finishing the technical face to form a raised or fleece surface region; printing at least one selected region of the technical back with a resist material; after aging and washing, raising or fleecing, and then shearing, the technical back of the fabric body, with fibers in the selected region(s) printed with resist material matted or held against the technical back of the fabric body by resist material, thus limiting raising or fleecing; tumbling the fabric body to gather or clump raised or fleece fibers away from the selected region(s) of the technical back printed with resist material; and over-dyeing at least one raised or fleece surface region of technical back color B.

In a preferred embodiment of this aspect of the invention, the step of over-dyeing comprises applying a pattern of regions of color B to the technical back.

Objectives of the invention include providing a fabric, e.g., a knit fabric, having a first surface and an opposite, second surface of a contrasting, i.e., different, color. Preferably, both surfaces of the fabric are subjected to a fabric finishing process, e.g., both surfaces of the fabric body may be napped, brushed, sanded, etc., to form fleece, and then sheared. The raised or fleece regions of one or both surfaces of the fabric may be bordered by resist regions that are not raised, to the effect that the design elements of the raised or fleece regions stand out in relief.

The details of one or more embodiments of the invention are set forth in the accompanying drawings and the description below. Other features, objects, and advantages of the invention will be apparent from the description and drawings, and from the claims.

DESCRIPTION OF DRAWINGS

FIGS. 5–11 are sequential views of a cylinder latch needle in a reverse plaiting circular knitting process, e.g. for use in forming fabrics of the invention.

Like reference symbols in the various drawings indicate like elements.

DETAILED DESCRIPTION

Figure 1:
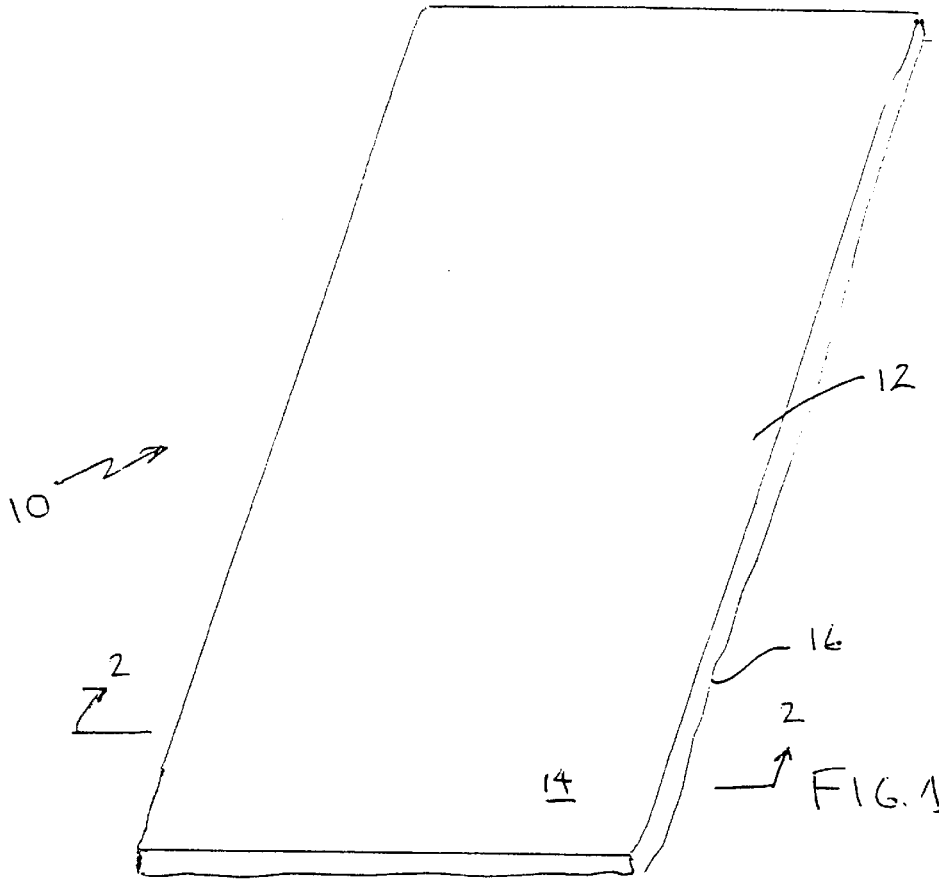
FIG. 1 is a perspective view of a body of raised fabric of one embodiment the invention.
Figure 2:
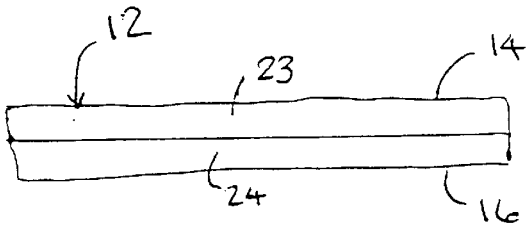
FIG. 2 is a side view of the body of raised fabric of the embodiment of FIG. 1, taken at the line 2—2 of FIG. 1.

Referring to FIGS. 1 and 2, a raised fabric 10 of the invention consists of a fabric body 12 having a technical back 14 and a technical face 16 of contrasting, i.e., different, colors (C', C").

Figure 3:
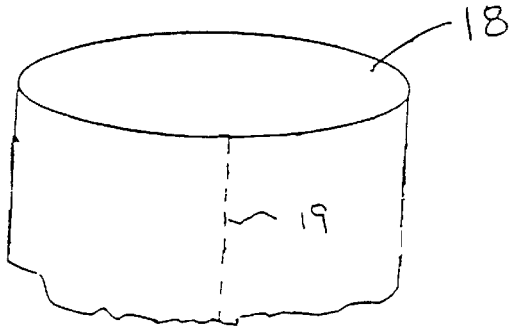
FIG. 3 is a somewhat diagrammatic sectional view of a segment of a tubular knit fabric prebody during knitting.
Figure 4:
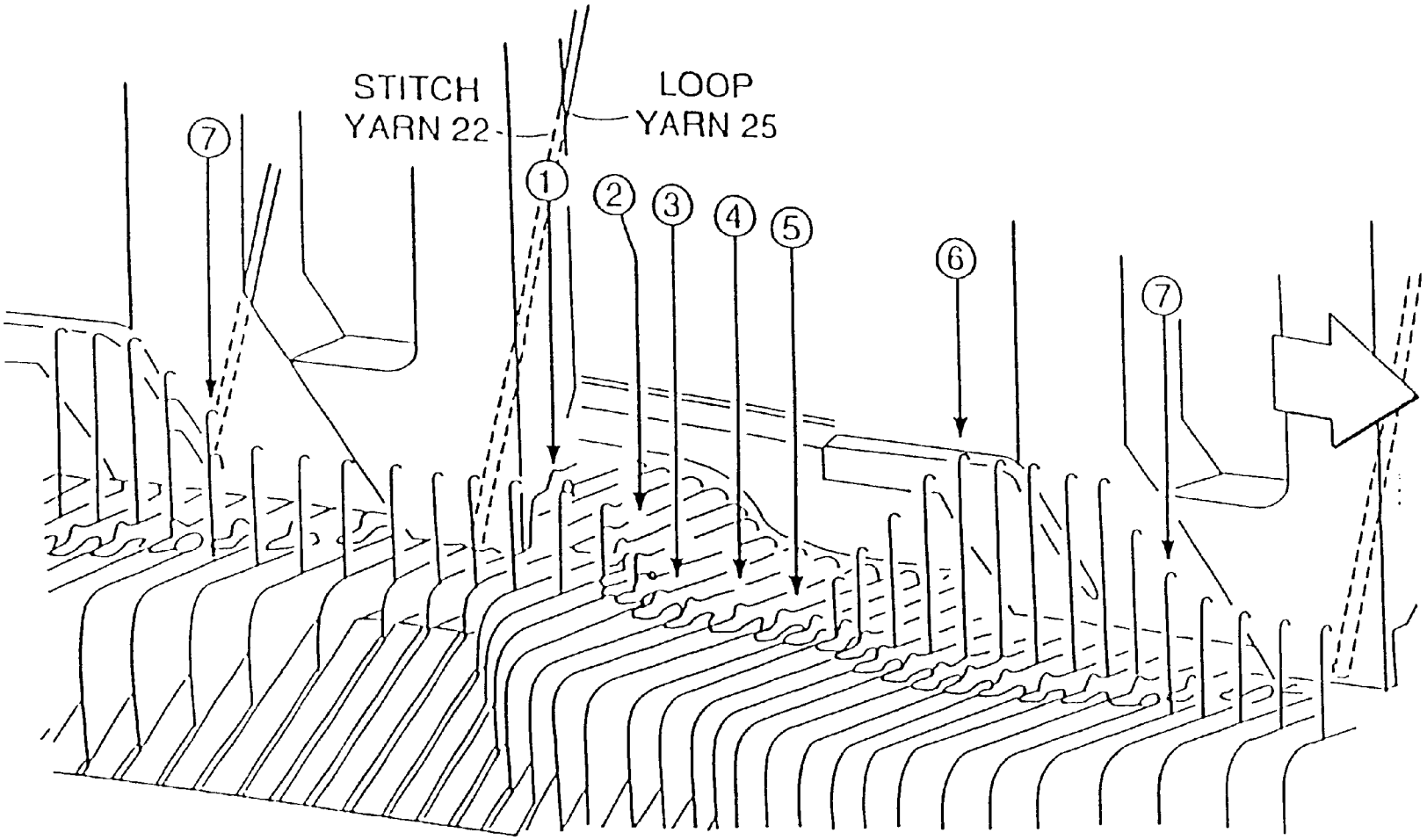
FIG. 4 is a perspective view of a segment of a circular knitting machine.

Referring also to FIG. 3, and to FIGS. 4–11, in a preferred embodiment, a fabric prebody 18 is formed by joining a stitch yarn 22 and a loop yarn 25 in a standard reverse plaiting circular knitting (terry knitting) process, e.g. as described in *Knitting Technology*, by David J. Spencer (Woodhead Publishing Limited, 2nd edition, 1996), the entire disclosure of which is incorporated herein by reference. In the terry knitting process, the stitch yarn 22 forms the technical face 16 of the resulting fabric prebody 18 and the loop yarn 25 forms the opposite technical back 14, where it is formed into loops extending over the stitch yarn 22. In the fabric prebody 18 formed by reverse plaiting circular knitting, the loop yarn 25 extends outwardly from the planes of both surfaces and, on the technical face 16, the loop yarn 25 covers the stitch yarn 22. As a result, during finishing of the opposite fabric surfaces to form a fleece, the loop yarn 25 protects the stitch yarn 22.

The loop yarn 25 forming the technical back 14 of the knit fabric prebody 18 can be made of any synthetic or natural material, with cross section and luster of the fibers or the filament also selected to meet requirements of the intended end use. The loop yarn can be a spun yarn made by any available spinning technique, or a filament yarn made by extrusion. The loop yarn denier is typically between 40 denier to 300 denier. A preferred loop yarn is a 200/100 denier T-653 Type flat polyester filament, e.g. as available commercially from E.I. du Pont de Nemours and Company, of Wilmington, Del.

The stitch yarn 22 forming the technical face 16 of the knit fabric prebody 18 can be also made of any type of synthetic or natural material in a spun yarn or a filament yarn. The denier is typically between 50 denier to 150 denier. A preferred yarn is a 70/34 denier filament textured polyester, e.g. as available commercially from UNIFI, Inc., of Greensboro, N.C.

The tubular knit prebody 18 is removed from the knitting machine and slit, e.g. randomly, or along a line of stitches 19 marking the desired slit line, to create a planar fabric. Alternatively, for increased accuracy, the tubular knit prebody 18 may be slit on line, e.g. by a cutting edge mounted to the knitting machine.

Referring again to FIGS. 1 and 2, according to one method of the invention, the standard terry knit fabric prebody 18 (FIG. 3), made by the reverse plaiting process described above, is first dyed with disperse dyestuffs of color A, preferably with a chromophoric structure, such as azo dyes. The knitted, dyed fabric prebody 18 is then finished by raising and shearing one or preferably both surfaces of the prebody to form the fabric body 12 with fleece 23, 24 formed on both faces of the fabric body 12, including on the technical back 14, in the loop yarn, and on the technical face 16, in the overlaying loops of the loop yarn and in the stitch yarn.

For the purpose of removing the dye of color A from one surface only, a first surface, e.g., technical back 14, of the fabric body 12 is coated with a discharge chemical, e.g., an oxidizing agent, such as benzoyl peroxide, or a reducing agent, such as sodium sulfoxylate. The discharge chemical is applied as a foam or as a paste or as a liquid, using standard coating equipment, e.g., a kiss roll, transfer roll, knife over roll, or the like, or a flat bed or rotary screen, or the like. The object is to remove the color A from one surface only, e.g., from the technical back 14, and the discharge chemical is applied in a manner to restrict, or, more preferably, prevent, penetration to the opposite, second surface, e.g., the technical face 16, which is kept dry. Since both surfaces of the fabric body 12 of the invention are raised, penetration of the discharge chemical to the opposite surface is less likely to occur.

Penetration of the discharge chemical, and, in turn, the new color (color B), can also be controlled by one or a combination of means, e.g., by rheology of the particular chemicals, the viscosity of the particular chemical, and/or by the pressure of application. Other means for controlling penetration include modifying the surface tension of the fibers to render them hydrophilic, which will result in deeper penetration, or, conversely, by treating the fabric with water repellent chemicals, which will result in more of a tipping effect.

Discharging of the color A from the first surface, e.g., from the technical back 14, is accomplished by drying the treated fabric body 12, e.g., in a tunnel oven between 180° F. and 400° F., followed by steaming at high temperatures or in high pressure saturated steam. The fabric is subsequently washed to remove excess chemicals, and dried again.

A second (contrasting, new) color (color B) is applied to the discharged (first) surface, e.g., the technical back 14, by one of the methods described above, i.e., by means of a kiss roll, transfer roll, knife over roll, or the like, or by means of a flat bed screen or rotary screen, or the like.

Alternatively, the new color (color B) may be applied in tandem with the discharge chemical, i.e. before drying, steaming and washing, in a "wet-on-wet" application, in which case, the dyestuffs must be non-dischargeable, or applied immediately after steaming or washing of the discharge chemicals.

Figure 12:
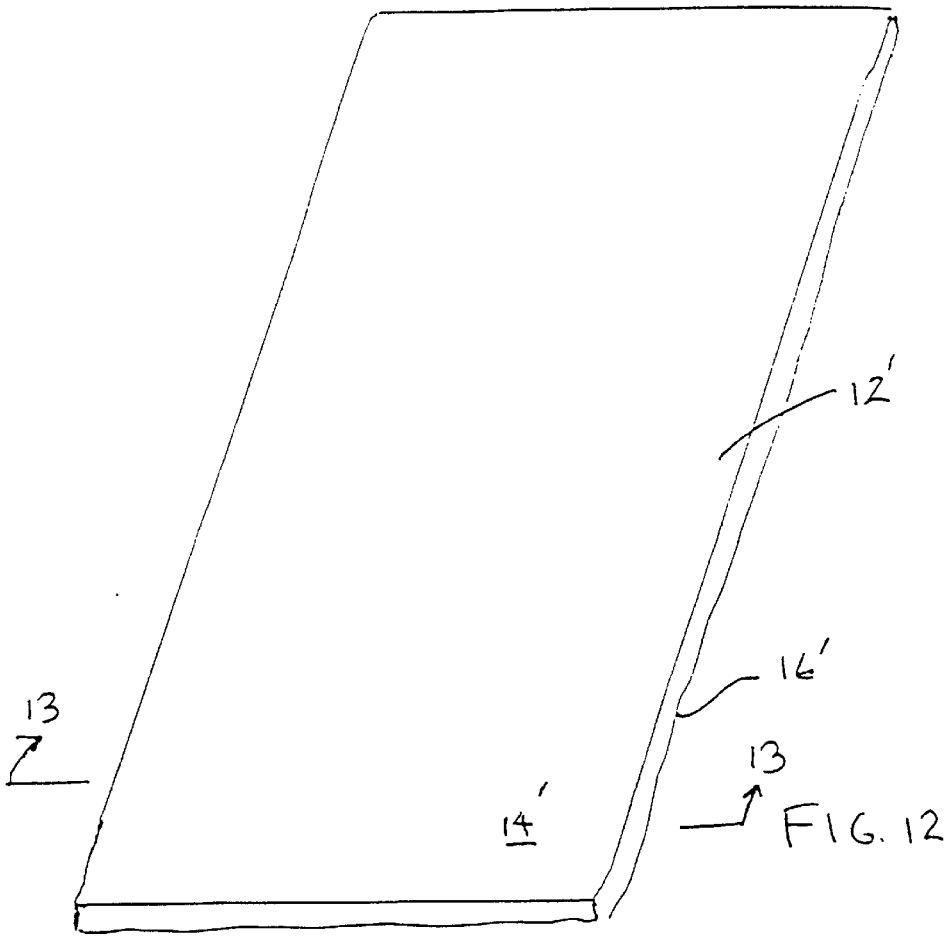
FIG. 12 is a perspective view of a body of raised fabric of another embodiment of the invention.
Figure 13:
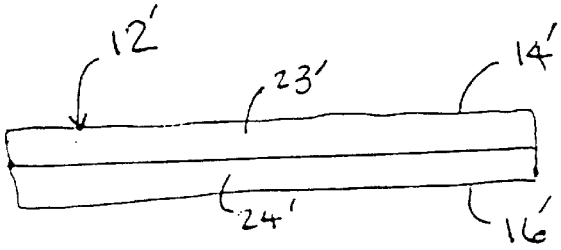
FIG. 13 is a side sectional view of the body of raised fabric of the embodiment of FIG. 12, taken at the line 13—13 of FIG. 12.

Referring now to FIGS. 12 and 13, according to another method of the invention, the standard terry knit fabric prebody 18 (FIG. 3), again made by the reverse plaiting process described above, is first dyed with disperse dyestuffs of a color A, preferably with a chromophoric structure, such as azo dyes. The knitted, dyed fabric prebody 18 is then finished by raising and shearing both surfaces of the prebody to form the fabric body 12' with fleece 23', 24' formed on both faces of the fabric body 12', including on the technical back 14', in the loop yarn, and on the technical face 16', in the overlaying loops of the loop yarn and in the stitch yarn.

A dye of a second, contrasting new color (color B) is applied on top of the original color (color A) ("over-dyed") on the technical back 14', in the loop yarn, as a foam or as a paste or as a liquid, using standard coating equipment, e.g. a kiss roll, transfer roll, knife over roll, or the like, or a flat bed or rotary screen, or the like. The object is to apply the dye of the contrasting, new color (color B) to one surface only, e.g., the technical back 14', and the dye of the new color (color B) is applied in a manner to restrict, or, more preferably, prevent, penetration to the opposite, second surface, e.g., the technical face 16', which is kept dry. If the technical face 16' is raised before over-dyeing of the technical back 14', penetration of the dye will be minimized, thereby to maximize the contrast between the color of the technical face 16' (color A) and the color of the technical back 14' (color B).

According to another method of the invention, a standard terry, reverse circular knit fabric prebody knitted on a circular knitting machine, e.g. as described above with respect to FIG. 3, is printed at selected region(s) of one or both surfaces with a resist material. The fabric prebody is then finished to create a final fabric body having one or more raised or fleece regions on one or both surfaces bordered or outlined by resist region(s) that are not raised. The effect is to create contour in the surface(s) of the fabric body, with the design elements of the raised or fleece regions standing out in relief from regions printed with the resist.

Figure 14:
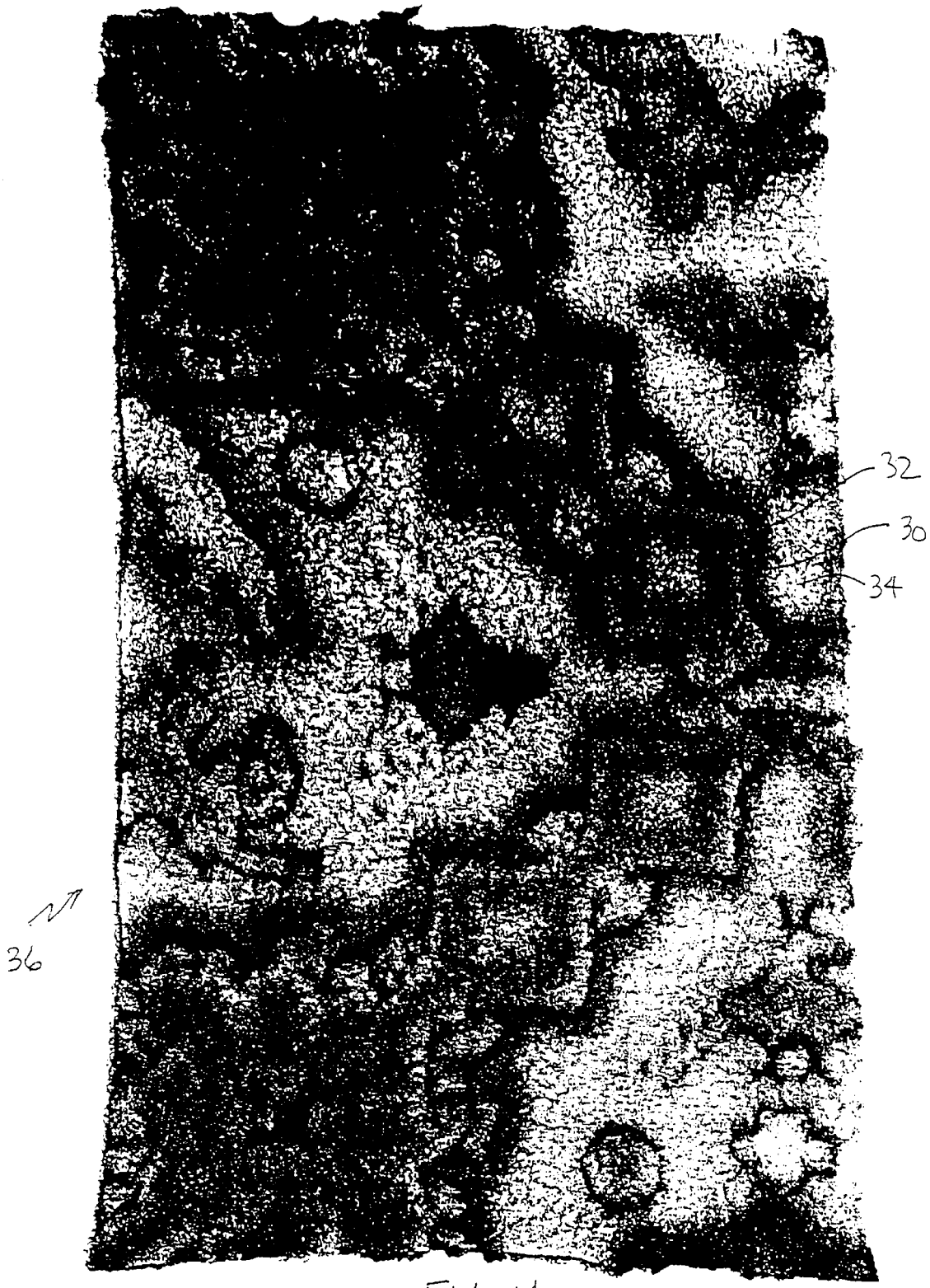
FIG. 14 is a plan view of one surface of a body of raised, relief fabric of still another embodiment of the invention.
Figure 15:
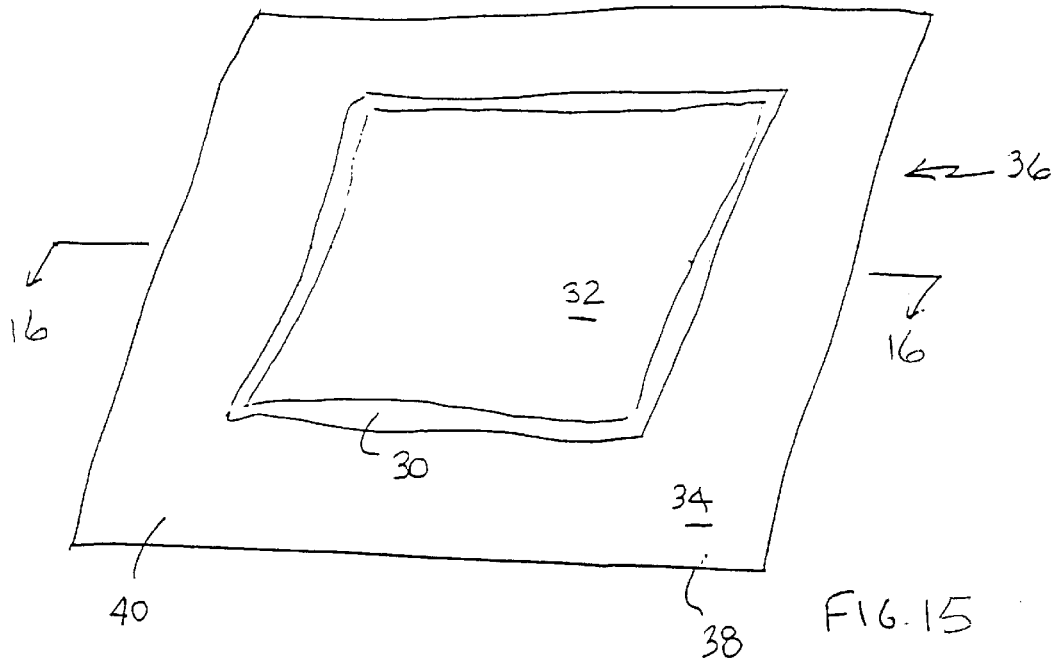
FIG. 15 is a perspective view of the body of raised, relief fabric of FIG. 14.
Figure 16:
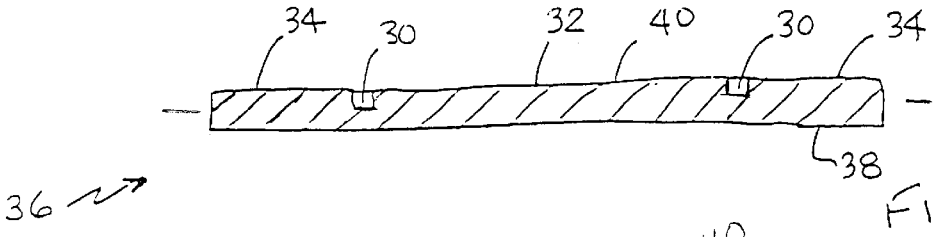
FIG. 16 is a side sectional view of a raised, relief fabric body of one embodiment of the invention of FIG. 14, taken at the line 16—16 of FIG. 14, with raised relief or contours formed on one surface of the fabric body.

Referring to FIGS. 14 and 15, and also to FIG. 16, according to one embodiment of this aspect of the invention, in order to achieve maximum relief or contour between raised or fleece regions 32, 34 and bordering resist region(s) 30, the fabric prebody 18 is first treated to raise or fleece the technical face 38. The technical back 40 is then printed at the selected region(s) 30, e.g., using a print screen, with a resist material, such as acrylate, poly urethane, styrene butadiene latex and the like. The fabric prebody technical back may then be printed in the other regions 32, 34 with one or more additional colors, e.g. color B, B', etc., without resist material, using subsequent print screens in series. Finally, after aging and washing, the technical back 40 of the fabric prebody 18 is raised or fleeced, using known processes, and then sheared to form a fabric body 36. During these steps, the fibers in regions 32, 34 coated with resist material are matted or held against the surface of the fabric prebody by the resist material, and thus avoid being raised or fleeced. The raised fabric body 36 is thereafter tumbled (i.e., wetted with steam, then tumble dried) to further accentuate the relief 30 by gathering or clumping the raised fibers in fleece regions 32, 34 away from the region(s) 30 printed with the resist material.

Figure 17:
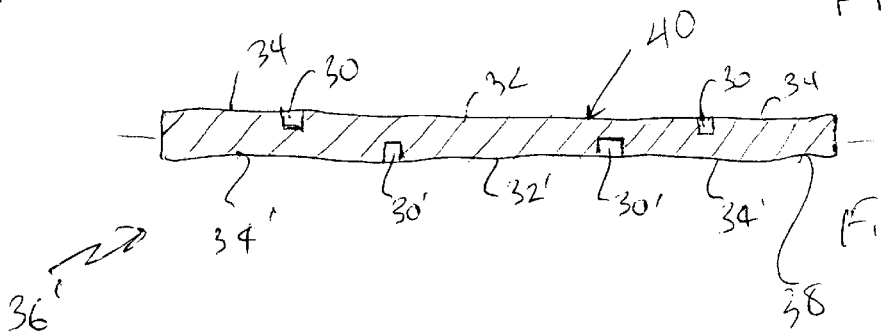
FIG. 17 is a side sectional view of a raised, relief fabric body of another embodiment of the invention of FIG. 14, with raised relief or contours formed on both surfaces of the fabric body.

Referring again to FIG. 14, and now also to FIG. 17, according to another embodiment of this aspect of the invention, the fabric prebody 18 is first printed at the selected regions 30, 30' of both the technical back 40 and the technical face 38, respectively, again, e.g., using a print screen, with a resist material, such as acrylate, poly urethane, styrene butadiene latex and the like. The fabric prebody technical back and/or technical face may then be printed in the other regions 32, 34 and 32', 34', respectively, with one or more additional colors, e.g. color B, B', etc., without resist material, using subsequent print screens in series. Finally, after aging and washing, the technical back 40 and the technical face 38 of the fabric prebody 18 are raised or fleeced, using known processes, and then sheared to form a fabric body 36'. During these steps, the fibers in regions 32, 34 and 32', 34' coated with resist material are matted or held against the respective surfaces of the fabric prebody by the resist material, and thus avoid being raised or fleeced. The raised fabric body 36' is thereafter tumbled (i.e., wetted with steam, then tumble dried) to further accentuate the relief areas 30, 30' by gathering or clumping the raised fibers in fleece regions 32, 34 and 32', 34' away from the regions 30, 30' printed with the resist material.

The original color (color A) may thereafter be discharged from the technical back 14, e.g., as described above, or the technical back 14 may be left undyed, or a second (new) color (color B) may be applied to the technical back, or the technical back may be over-dyed a new color (color B), also as described above.

In other embodiments of this aspect of the invention, the chemical resist material may be clear, or colored, as desired, prior to application.

EXAMPLES

The following are examples of different aspects of the methods of the invention:

Example 1

A fabric body of the invention having a first surface and an opposite, second surface of contrasting colors may be formed by the steps of:

1. Forming a fabric prebody having first surface and an opposite, second surface;
2. Dyeing the fabric prebody a first color (color A);
3. Transforming the fabric prebody into a fabric body by finishing the first surface to form a fleece surface region thereupon;
4. Removing dye of color A from the fleece surface region of the first surface; and
5. Re-dyeing the fleece surface region of the first surface a second color (color B) contrasting to color A.

Example 1A

Alternatively, the steps of Example 1 may be performed as described above, except, in Step 3, the opposite, second surface is finished to form a fleece surface region thereupon. The dye of color A is then removed from the fleece surface region of the second surface, and the fleece region is re-dyed color B.

Example 1B

Alternatively, the steps of Example 1 or Example 1A may be performed as described above, except, in Step 3, both the first surface and the opposite, second surface are finished to form a fleece surface region upon each surface. The dye of color A may then be removed from the fleece surface region of either surface (or both surfaces), and the fleece region(s) re-dyed color B.

Example 2

A fabric body of the invention having a first surface and an opposite, second surface of contrasting colors, e.g., a color A and a color B contrasting to color A, is formed by the steps of:

1. Forming a fabric prebody having first surface and an opposite, second surface;
2. Dyeing the fabric prebody color A;
3. Transforming the fabric prebody into a fabric body by finishing the first surface to form a fleece surface region thereupon; and
4. Over-dyeing the fleece surface region of the first surface color B.

Example 2A

Alternatively, the steps of Example 2 may be performed as described above, except, in Step 3, the opposite, second surface is finished to form a fleece surface region thereupon. The fleece surface region of the second surface is then over-dyed color B.

Example 2B

Alternatively, the steps of Example 2 or Example 2A may be performed as described above, except, in Step 3, both the first surface and the opposite, second surface are finished to form a fleece surface region upon each surface. The fleece surface region of either surface (or both surfaces) may then be over-dyed color B.

Figure 18:
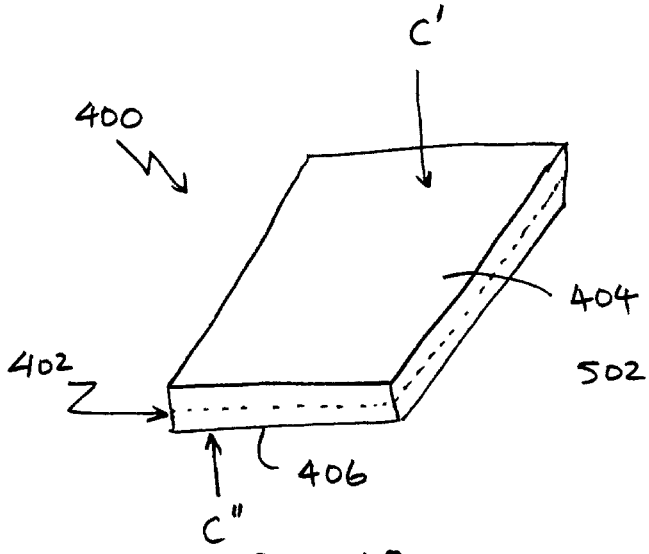
FIGS. 18 and 19 are somewhat diagrammatic perspective views of fabrics of the invention formed according to examples of methods of the invention.

The methods of Examples 1 and 2 thus result in a fabric 400 (FIG. 18) having a raised body 402 with a first surface 404 and a second, opposite surface 406 of a contrasting colors (C', C").

Example 3

A fabric of the invention having at least one raised or fleece surface region on one surface, bordered by a surface region not raised or fleece, may be formed by the steps of:

1. Raising or fleecing the technical face of a standard terry, reverse circular knit fabric prebody having a technical face and a technical back to form a fabric body;
2. Printing at least one selected region of the technical back with a resist material;
3. After aging and washing, raising or fleecing, and then shearing, the technical back of the fabric prebody, with fibers in the selected region or regions printed with the resist material matted or held against the technical back of the fabric body by the resist material, thus limiting raising or fleecing; and
4. Tumbling the fabric body to gather or clump the raised or fleece fibers away from the selected region or regions printed with the resist material.

Example 4

A fabric of the invention having at least one raised or fleece region on one or both surfaces, each bordered by a surface region not raised or fleece, may be formed by the steps of:

1. Printing at least one selected region of the technical face and/or the technical back of a standard terry, reverse circular knit fabric prebody of color A, having a technical face and a technical back, with a resist material;
2. After aging and washing, raising or fleecing, and then shearing, the technical face and/or the technical back of the fabric prebody to form a fabric body, with fibers in the selected region(s) printed with resist material matted or held against the technical face and/or the technical back of the fabric body by the resist material, thus limiting raising or fleecing; and
3. Tumbling the fabric body to gather or clump the raised or fleece fibers away from the selected region(s) printed with resist material.

Example 4A

Alternatively, the steps of Example 4 may be performed as described above, except, in Step 3, the opposite surface is finished to form a fleece surface region thereupon. The fleece surface region of the second surface is then over-dyed color B contrasting to color A.

Example 4B

Alternatively, the steps of Example 4 or Example 4A may be performed as described above, except, in Step 3, both surfaces are finished to form a fleece surface region upon each surface. The fleece surface region of either surface (or both surfaces) may then be over-dyed color B contrasting to color A.

Example 4C

In a further step, at least one of the technical face and the technical back of the fabric prebody, and preferably both the technical face and the technical back, are printed with one or more additional colors (color B, B', etc.) using subsequent print screens in series.

Figure 19:
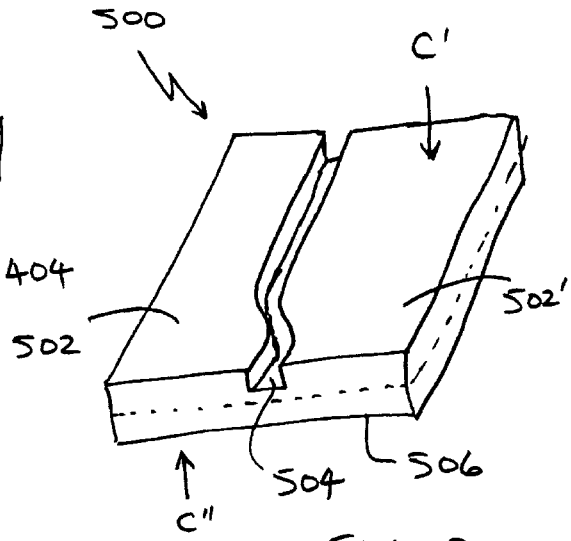

The methods of Examples 3 and 4 thus result in a fabric 500 (FIG. 19) having one or more raised or fleece regions 502, 502' bordered by a resist region 504 not raised or fleece, to the effect that the design elements of the bordered raised or fleece region stands out in relief. The opposite surfaces (502, 502'; 506) may have contrasting colors (C', C").

Example 5

A fabric body of the invention having a technical face with a raised or fleece surface region, and a technical back with at least one raised or fleece surface region bordered by a surface region not raised or fleece, one surface being of a color A and the other surface being of a color B contrasting to color A, may be formed by the steps of:

1. Dyeing a standard terry, reverse circular knit fabric prebody having a technical face and a technical back a first color (color A);
2. Transforming the fabric prebody into a fabric body by finishing the technical face to form a raised or fleece surface region;
4. Removing dye of color A from the raised or fleece surface region of the technical face;
5. Printing at least one selected region of the technical back with a resist material;
6. After aging and washing, raising or fleecing, and then shearing, the technical back of the fabric body, with fibers in the selected region or regions printed with resist material matted or held against the technical back of the fabric body by resist material, thus limiting raising or fleecing;
7. Tumbling the fabric body to gather or clump raised or fleece fibers away from the selected region or regions of the technical back printed with resist material; and
8. Over-dyeing the raised or fleece surface region of the technical face a second color (color B).

Example 6

A fabric body of the invention having a technical face with a raised or fleece surface region, and a technical back with at least one raised or fleece surface region bordered by a surface region not raised or fleece, one surface being of a color A and the other surface being of a color B contrasting to color A, may be formed by the steps of:

1. Dyeing a standard terry, reverse circular knit fabric prebody having a technical face and a technical back color A;
2. Transforming the fabric prebody into a fabric body by finishing the technical face to form a raised or fleece surface region;
3. Printing at least one selected region of the technical back with a resist material;
4. After aging and washing, raising or fleecing, and then shearing, the technical back of the fabric body, with fibers in the selected region(s) printed with resist material matted or held against the technical back of the fabric body by resist material, thus limiting raising or fleecing;

5. Tumbling the fabric body to gather or clump raised or fleece fibers away from selected region or regions of the technical back printed with resist material; and
6. Over-dyeing the raised or fleece surface region of the technical face color B.

Example 7

A fabric body of the invention having a technical face with a raised or fleece surface region, and a technical back with at least one raised or fleece surface region bordered by a surface region not raised or fleece, one surface being of a color A and the other surface being of a color B contrasting to color A, may be formed by the steps of:

1. Dyeing a standard terry, reverse circular knit fabric prebody having a technical face and a technical back of color A;
2. Printing at least one selected region of the technical back with a resist material;
3. After aging and washing, raising or fleecing, and then shearing, the technical face and the technical back of the fabric prebody to form a fabric body, with fibers in the selected region or regions of the technical back printed with resist material matted or held against the technical back of the fabric body by the resist material, thus limiting raising or fleecing;
4. Tumbling the fabric body to gather or clump raised or fleece fibers away from the selected region or regions of the technical back printed with resist material; and
5. Over-dyeing the raised or fleece surface region of the technical face color B.

Example 7A

The steps of Example 7 may be performed as described above, except, in Step 5, at least one raised or fleece surface region of the technical face is over-dyed color B.

Example 7B

The steps of Example 7 or Example 7A may be performed as described above, except, in Step 5, the raised or fleece surface region of the technical face and at least one raised or fleece surface region of the technical back are over-dyed color B.

Example 8

A fabric body of the invention having a technical face with a raised or fleece surface region, and a technical back with at least one raised or fleece surface region bordered by a surface region not raised or fleece, one surface being of a color A and the other surface being of a color B contrasting to color A, may be formed by the steps of:

1. Dyeing a standard terry, reverse circular knit fabric prebody having a technical face and a technical back color A;
2. Transforming the fabric prebody into a fabric body by finishing the technical face to form a raised or fleece surface region;
3. Printing at least one selected region of the technical back with a resist material;
4. After aging and washing, raising or fleecing, and then shearing, the technical back of the fabric body, with fibers in the selected region or regions printed with resist material matted or held against the technical back of the fabric body by resist material, thus limiting raising or fleecing;
5. Tumbling the fabric body to gather or clump raised or fleece fibers away from the selected region or regions of the technical back printed with resist material; and
6. Over-dyeing at least one region of the raised or fleece surface region of the technical back color B.

Example 8A

The steps of Example 8 may be performed as described above, except, in Step 6, a pattern of regions of color B, B', etc. are applied to the technical back, contrasting to regions of color A on the technical back.

Example 9

A fabric body of the invention having a technical face with a raised or fleece surface region, and a technical back with at least one raised or fleece surface region bordered by a surface region not raised or fleece, one surface being of a color A and the other surface being of a color B contrasting to color A, may be formed by the steps of:

1. Dyeing a standard terry, reverse circular knit fabric prebody having a technical face and a technical back color A;
2. Transforming the fabric prebody into a fabric body by finishing the technical face to form a raised or fleece surface region;
3. Printing at least one selected region of the technical back with a resist material;
4. After aging and washing, raising or fleecing, and then shearing, the technical back of the fabric body, with fibers in the selected region or regions printed with resist material matted or held against the technical back of the fabric body by resist material, thus limiting raising or fleecing;
5. Tumbling the fabric body to gather or clump raised or fleece fibers away from the selected region or regions of the technical back printed with resist material; and
7. Over-dyeing regions of the fleece surface region of the technical back color B.

Example 9A

The steps of Example 9 may be performed as described above, except, in Step 7, a pattern of regions of color B, B', etc. are applied to the technical back.

A number of embodiments of the invention have been described. Nevertheless, it will be understood that various modifications may be made without departing from the spirit and scope of the invention. For example, any type of yarn may be employed. The discharge chemical and the second (new) color (color B) may also be applied in other suitable medium by other suitable means.

Accordingly, other embodiments are within the scope of the following claims.

What is claimed is:

1. A method of forming a fabric body having a first surface and an opposite, second surface, wherein one surface is of a color A and the other surface is of a color B contrasting to color A, said method comprising the steps of, in sequence:

forming a fabric prebody having a first surface and an opposite, second surface;

dyeing said fabric prebody color A;

transforming said fabric prebody into a fabric body by finishing at least one of said first surface and said opposite, second surface to form a raised or fleece surface region;

removing dye of color A from said raised or fleece surface region of one surface; and re-dyeing said raised or fleece surface region of said one surface color B.

2. The method of claim 1, wherein said step of transforming said fabric prebody comprises finishing said first surface.

3. The method of claim 1, wherein said step of transforming said fabric prebody comprises finishing said opposite, second surface.

4. The method of claim 1, wherein said step of transforming said fabric prebody comprises finishing said first surface and said opposite, second surface.

5. A method of forming a fabric body having a first surface and an opposite, second surface, wherein one surface is of a color A and the other surface is of a color B contrasting to color A, said method comprising the steps of, in sequence:

forming a fabric prebody having a first surface and an opposite, second surface;

dyeing said fabric prebody color A;

transforming said fabric prebody into a fabric body by finishing at least one of said first surface and said opposite, second surface to form a fleece surface region; and over-dyeing said fleece surface region of one surface color B.

6. The method of claim 5, wherein said step of transforming said fabric prebody comprises finishing said first surface.

7. The method of claim 5, wherein said step of transforming said fabric prebody comprises finishing said opposite, second surface.

8. The method of claim 5, wherein said step of transforming said fabric prebody comprises finishing said first surface and said opposite, second surface.

9. A method of forming a fabric having at least one raised or fleece surface region on at least one surface bordered by a surface region not raised or fleece, said method comprising the steps of, in sequence:

on a standard terry, reverse circular knit fabric prebody having a technical face and a technical back, raising or fleecing said technical face;

printing at least one selected region of said technical back with a resist material;

after aging and washing, raising or fleecing, and then shearing, said technical back of said fabric prebody to form a fabric body, with fibers in said at least one selected region printed with said resist material matted or held against said technical back of said fabric body by said resist material, thus limiting raising or fleecing; and tumbling said fabric body to gather or clump said raised or fleece fibers away from said at least one selected region printed with said resist material.

10. A method of forming a fabric having at least one raised or fleece region on one or both surfaces, bordered by a surface region not raised or fleece, said method comprising the steps of, in sequence:

on a standard terry, reverse circular knit fabric prebody having a technical face and a technical back, printing at least one selected region of at least one of said technical face and said technical back with a resist material;

after aging and washing, raising or fleecing, and then shearing, said technical face and said technical back of said fabric prebody to form a fabric body, with fibers in said at least one selected region printed with said resist material matted or held against said at least one of said technical face and said technical back of said fabric body by said resist material, thus limiting raising or fleecing; and tumbling said fabric body to gather or clump said raised or fleece fibers away from said at least one selected region printed with said resist material.

11. The method of claim 10, wherein said method comprises the further step of:

printing at least one of said technical face and said technical back of said fabric prebody with one or more additional colors using subsequent print screens in series.

12. The method of claim 11, wherein said method comprises the further step of:

printing said technical face and said technical back of said fabric prebody with one or more additional colors using subsequent print screens in series.

13. A method of forming a fabric body having a technical face with a raised or fleece surface region, and a technical back with at least one raised or fleece surface region bordered by a surface region not raised or fleece, wherein one technical surface is of a color A and the other technical surface is of a color B contrasting to color A, said method comprising the steps of, in sequence:

on a standard terry, reverse circular knit fabric prebody having a technical face and a technical back, dyeing said fabric prebody color A;

transforming said fabric prebody into a fabric body by finishing said technical face to form a raised or fleece surface region;

removing dye of color A from said raised or fleece surface region of said technical face;

printing at least one selected region of said technical back with a resist material;

after aging and washing, raising or fleecing, and then shearing, said technical back of said fabric body, with fibers in said at least one selected region printed with said resist material matted or held against said technical back of said fabric body by said resist material, thus limiting raising or fleecing;

tumbling said fabric body to gather or clump raised or fleece fibers away from said at least one selected region of said technical back printed with said resist material; and re-dyeing said raised or fleece surface region of said technical face color B.

14. A method of forming a fabric body having a technical face with a raised or fleece surface region, and a technical back with at least one raised or fleece surface region bordered by a surface region not raised or fleece, wherein one technical surface is of a color A and the other technical surface is of a color B contrasting to color A, said method comprising the steps of, in sequence:

on a standard terry, reverse circular knit fabric prebody having a technical face and a technical back, dyeing said fabric prebody color A;

transforming said fabric prebody into a fabric body by finishing said technical face to form a raised or fleece surface region;

printing at least one selected region of said technical back with a resist material;

after aging and washing, raising or fleecing, and then shearing, said technical back of said fabric body, with fibers in said at least one selected region printed with said resist material matted or held against said technical back of said fabric body by said resist material, thus limiting raising or fleecing;

tumbling said fabric body to gather or clump raised or fleece fibers away from said at least one selected region of said technical back printed with said resist material; and over-dyeing said raised or fleece surface region of said technical face color B.

15. A method of forming a fabric body having a technical face with a raised or fleece surface region, and a technical back with at least one raised or fleece surface region bordered by a surface region not raised or fleece, wherein one technical surface is of a color A and the other technical surface is of a color B contrasting to color A, said method comprising the steps of, in sequence:

on a standard terry, reverse circular knit fabric prebody having a technical face and a technical back, dyeing a fabric prebody color A;

printing at least one selected region of said technical back with a resist material;

after aging and washing, raising or fleecing, and then shearing, said technical face and said technical back of said fabric prebody to form a fabric body, with fibers in said at least one selected region of said technical back printed with said resist material matted or held against said technical back of said fabric body by said resist material, thus limiting raising or fleecing;

tumbling said fabric body to gather or clump raised or fleece fibers away from said at least one selected region of said technical back printed with said resist material; and over-dyeing at least one said raised or fleece surface region of at least one of said technical face and said technical back color B.

16. The method of claim 15, wherein said step of over-dyeing comprises over-dyeing said raised or fleece surface region of said technical face a color B.

17. The method of claim 15, wherein said step of over-dyeing comprises over-dyeing at least one said raised or fleece surface region of said technical back a color B.

18. The method of claim 15, wherein said step of over-dyeing comprises over-dyeing said raised or fleece surface region of said technical face a color B and over-dyeing at least one said raised or fleece surface region of said technical back a color B.

19. A method of forming a fabric body having a technical face with a raised or fleece surface region, and a technical back with at least one raised or fleece surface region bordered by a surface region not raised or fleece, wherein one technical surface is of a color A and the other technical surface is of a color B contrasting to color A, said method comprising the steps of, in sequence:

on a standard terry, reverse circular knit fabric prebody having a technical face and a technical back, dyeing said fabric prebody color A;

transforming said fabric prebody into a fabric body by finishing said technical face to form a raised or fleece surface region;

printing at least one selected region of said technical back with a resist material;

after aging and washing, raising or fleecing, and then shearing, said technical back of said fabric body, with fibers in said at least one selected region printed with said resist material matted or held against said technical back of said fabric body by said resist material, thus limiting raising or fleecing;

tumbling said fabric body to gather or clump raised or fleece fibers away from said at least one selected region of said technical back printed with said resist material; and over-dyeing at least one region of said raised or fleece surface region of said technical back color B.

20. The method of claim 19, wherein said step of over-dyeing comprises applying a pattern of regions of color B to said technical back contrasting to regions of color A on said technical back.

21. A method of forming a fabric body having a technical face with a raised or fleece surface region, and a technical back with at least one raised or fleece surface region bordered by a surface region not raised or fleece, wherein one technical surface is of a color A and the other technical surface is of a color B contrasting to color A, said method comprising the steps of, in sequence:

on a standard terry, reverse circular knit fabric prebody having a technical face and a technical back, dyeing said fabric prebody color A;

transforming said fabric prebody into a fabric body by finishing said technical face to form a raised or fleece surface region;

printing at least one selected region of said technical back with a resist material;

after aging and washing, raising or fleecing, and then shearing, said technical back of said fabric body, with fibers in said at least one selected region printed with said resist material matted or held against said technical back of said fabric body by said resist material, thus limiting raising or fleecing;

tumbling said fabric body to gather or clump raised or fleece fibers away from said at least one selected region of said technical back printed with said resist material; and over-dyeing at least one region of said fleece surface region of said technical back color B.

22. The method of claim 21, wherein said step of over-dyeing comprises applying a pattern of regions of color B to said technical back contrasting to regions of color A on said technical back.

23. The method of claim 1, wherein the fabric prebody is a single layer fabric with the first surface comprising fibers of a predetermined material and the opposite, second surface comprising fibers of said predetermined material.

24. The method of claim 5, wherein the fabric prebody is a single layer fabric with the first surface comprising fibers of a predetermined material and the opposite, second surface comprising fibers of said predetermined material.

* * * * *